United States Patent [19]

Moon et al.

[11] 3,977,646

[45] Aug. 31, 1976

[54] APPARATUS FOR MOLDING CONCRETE GIRDERS

[75] Inventors: John C. Moon, Ridgeland; Tom C. Brown, Jackson, both of Miss.

[73] Assignee: Madison Materials Co., Ridgeland, Miss.

[22] Filed: Sept. 5, 1974

[21] Appl. No.: 503,470

[52] U.S. Cl. ..... 249/50; 249/139; 249/165

[51] Int. Cl.[2] ..... B28B 7/00

[58] Field of Search ..... 249/50, 139, 155–156, 249/158, 165–166

[56] References Cited

UNITED STATES PATENTS

| | | | |
|---|---|---|---|
| 3,009,229 | 11/1961 | Tumey | 249/50 |
| 3,010,174 | 11/1961 | McCall | 249/50 |
| 3,071,833 | 1/1963 | Tumey | 249/155 |
| 3,071,834 | 1/1963 | Tumey | 249/50 |
| 3,071,835 | 1/1963 | Tumey | 249/155 |
| 3,092,886 | 6/1963 | Dykeman et al. | 249/158 |
| 3,193,242 | 7/1965 | Tumey et al. | 249/50 |
| 3,241,802 | 3/1966 | Lawrence | 249/47 |
| 3,275,282 | 9/1966 | Schulz | 249/163 |
| 3,625,468 | 12/1971 | Marcott | 249/165 |

*Primary Examiner*—Francis S. Husar
*Assistant Examiner*—John McQuade
*Attorney, Agent, or Firm*—Mason, Mason & Albright

[57] ABSTRACT

Mold apparatus for the manufacture and molding of structural members such as I-beams and concrete girders which has a permanent pallet supported and maintained in a level condition by parallel beams affixed to a concrete base. The pallet is made up of a plurality of sections mounted on the beams and aligned and rigidly connected together. A pair of side forms are provided on the pallet which are readily removable and replaceable by other forms depending upon the particular structure being molded, each such form having a horizontal foundation part which extends to the edge of the pallet where a strip is welded to position the mold as desired on the pallet. The inner portion of the foundation part merges with a molding part extending upwardly in each form and terminating in an upper flange extending horizontally and outwardly at the top of the form. A plurality of vertical stiffener plates connect the various parts of each form to provide rigidity. Also a stiffener angle piece is affixed to each form along the juncture of the foundation and molding parts. A plurality of openings are provided in the foundation part through the stiffener angle piece which are aligned with a further opening in the pallet. A readily removable key bolt type clamp extends through each of the aligned openings for rigidly clamping the forms to the pallet. Each such clamp comprises a bolt with a slot in its shank and a wedge which is receivable in the slot for rigidly clamping the foundation part to the pallet. Washers are provided between the wedges and and the stiffener angle pieces. Between each pallet section a connecting strip is provided having openings which match openings in the underlying pallet sections. Key bolts, as described, are utilized to clamp the strips to the sections and thus the sections are rigidly interconnected in their desired level position.

11 Claims, 12 Drawing Figures

APPARATUS FOR MOLDING CONCRETE GIRDERS

SUMMARY OF THE INVENTION

The invention relates to apparatus for molding concrete structural members such as I-beams, girders and the like. More particularly, it relates to a molding apparatus of such type having a permanent or fixed base, known as a pallet, that is used with a plurality of side molds for the manufacture and molding of various concrete structural members.

Forms presently used for the molding of concrete structures, such as I-beams and girders, require a different width of pallet for each different beam or girder of a different width to be molded. It is important that the pallets that make up the base be perfectly level and aligned. Thus, in removing and replacing the pallets for each change in beam width, a substantial amount of time and labor is required to level and align the pallets.

It has occurred to the inventors that substantial savings are possible through the provision of a permanently installed pallet which, when installed, is level and aligned and is used in conjunction with side forms, and can be quickly and readily secured to the pallet and removed therefrom and, further, perfectly aligned with a minimum of labor.

An operable apparatus which does, in fact, make possible the desired savings in time and money is a pallet comprised of a plurality of pallet sections mounted via transverse beams on a concrete base, the sections being aligned and rigidly connected by steel strips with openings which register with openings in the pallet sections and receive removable key bolts rigidly to interconnect the sections in the desired alignment, in combination with removable side forms each having a horizontal foundation part extending to the edge of the pallet and including a vertical form of molding part extending upwardly from the inner portion of the foundation part and an upper flange extending horizontally outwardly from the molding part of the form, vertical stiffeners being provided to give the forms rigidity and a further stiffener being provided at inner portion of the foundation part and the corner formed by the junction of the foundation part and the molding part. Through the horizontal stiffener, which is affixed to the form, a plurality of slots with their longitudinal axis parallel to the molding part of the form are provided which extend through the underlying horizontal foundation part to register, when the form is in correct alignment, with further slots in the underlying pallet. Such aligned slots receive readily removable key bolts which function rigidly to clamp the forms to the pallet. The clamping means comprise bolts having slots in their shanks for receiving wedges. Washers are located between the wedge and the underlying portion of the side forms. By tapping the wedges, which are received in the slots, into a frictionally secured position by means of a hammer or the like, the desired rigid structure is obtained. On the other hand, to remove the side forms, this is accomplished rapidly by removing the key bolts through tapping each wedge lightly from the smaller side and quickly withdrawing same and removing the bolt and washer.

To insure alignment of the edges of the foundation parts with the corresponding edge of the pallet, stop means are preferably welded on the outer sides of each form which are brought into engagement with the edges of the pallet.

In view of the foregoing, the important objects of this invention are to provide a base or pallet which: (1) can be installed permanently with the leveling and aligning accomplished at installation, (2) can be used to manufacture various sizes of girders and I-beams by use of specified side forms, (3) causes the side forms to be correctly aligned when secured to the pallet, (4) provides for the efficient placement and removal of the side forms with the minimum of labor, and (5) provides the molding operations to be carried out both effectively and efficiently with substantial savings in time and cost.

Other objects, adaptabilities and capabilities of the invention will be understood with reference to the following description of the preferred embodiment of the invention and the accompanying drawings, in which:

DESCRIPTION OF THE PREFERRED EMBODIMENT

Figure 11:
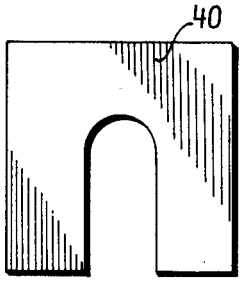
FIG. 11 shows a horseshoe washer which must be affixed to the underside of the pallets adjacent the key hole type openings.
Figure 4:
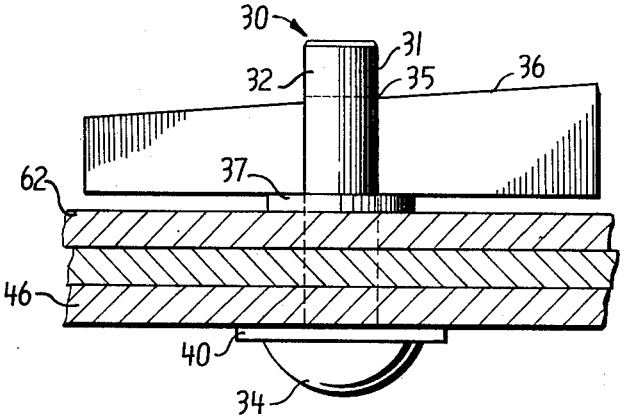
FIG. 4 is a sectional fragmentary view taken on 4—4 of FIG. 2 which shows the clamping structure.
Figure 7:
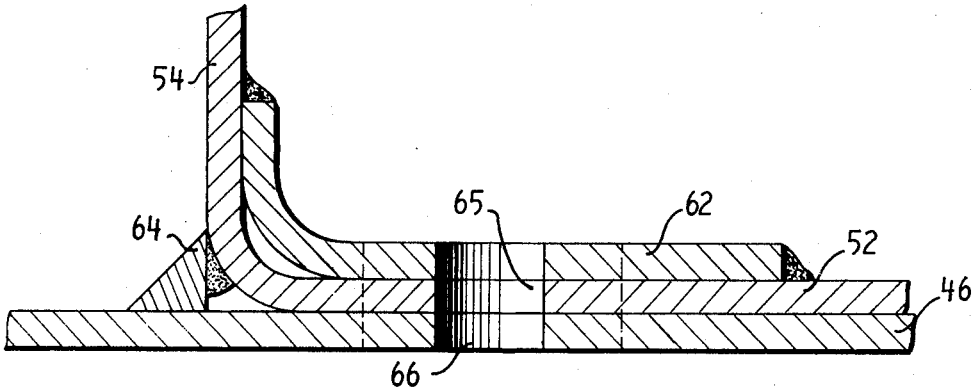
FIG. 7 is a sectional view taken on lines 7—7 of FIG. 5.
Figure 9:
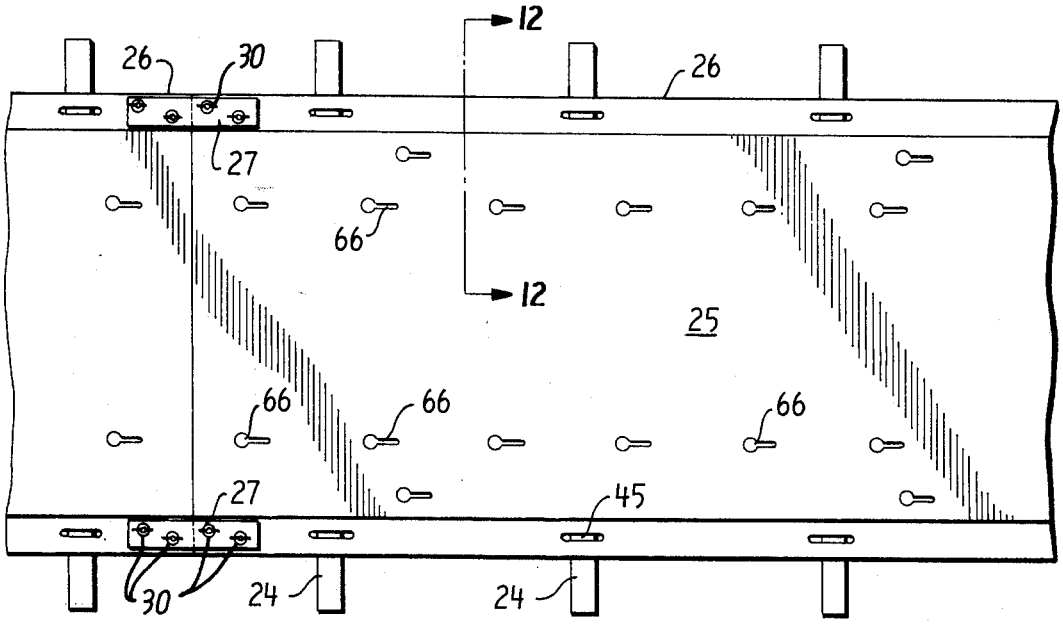
FIG. 9 is a broken plan view of the pallet.
Figure 8:
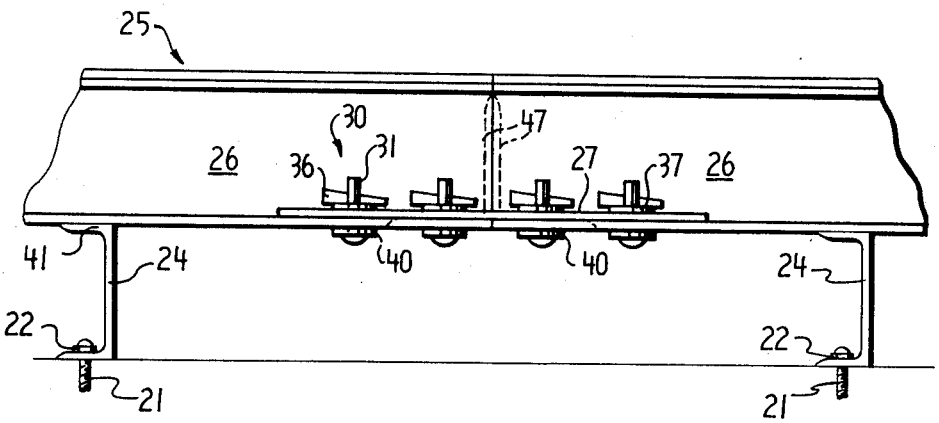
FIG. 8 is a fragmentary side view showing the structure for rigidly interconnecting adjacent pallet sections.

Referring to the Figures, a horizontal casting bed, comprising a concrete base 20, has affixed thereto by studs 21 and nuts 22 a plurality of steel channel beams 24 which, in practice, are spaced apart thirty inches from center to center. A permanent pallet designated generally 25 comprises a plurality of pallet sections 26 which are secured together end to end by strap means comprising steel straps 27 bridging pallet section 26. As shown in FIGS. 8 and 9, straps 27 are rigidly joined to sections 26 by clamp means comprising key bolts designated generally by reference numeral 30. Each key bolt 30, as shown in FIG. 4, comprises a bolt 31 which has a shank 32 and a head 34, a horizontal slot 35 being provided in shank 32 which is adapted to receive a steel wedge 36. A washer 37 is disposed between wedge 36 and the upper surface of a steel stiffener piece 62. A further horseshoe type washer 40 (illustrated separately in FIG. 11), permanently secured by welding or other suitable means to the underside of the top of pallet section 26, is disposed between the bolt head 34 and the under surface of a steel plate 46 of pallet section 26.

Figure 10:
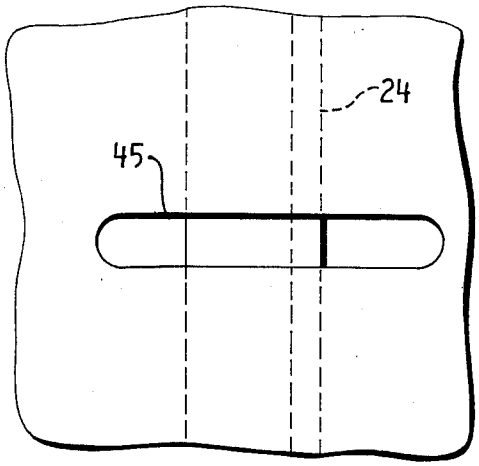
FIG. 10 is a detailed plan view of the key hole type opening in the pallet.
Figure 12:
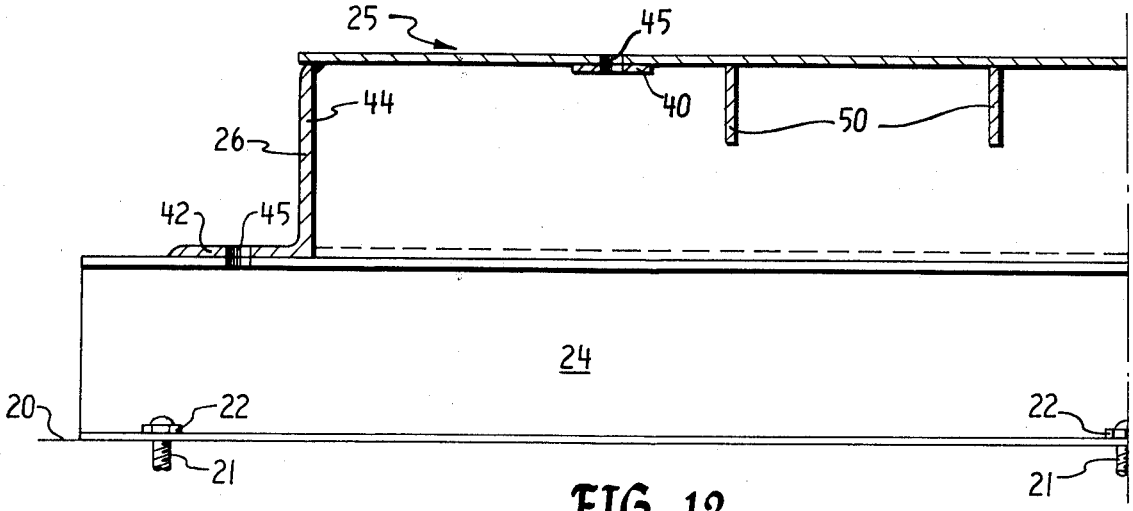
FIG. 12 is a sectional view taken on lines 12—12 of FIG. 9.

Pallet 25 is assembled of pallet sections 26 connected as described above for the entire length of base 20 and, by means of a surveyor's transit, pallet 25 is aligned, leveled and secured to the channel beams 24 by key bolts 30 as described above except that washers 37 may, if desired, be omitted. Openings for key bolts 30 in this instance are provided through the upper flange 41 of channel beam 24 and the adjacent horizontal flange 42 of an angle beam 44, one of which is provided on each side of a pallet section 26. The slots 45 as may be seen in FIGS. 9 and 10 are preferably about six inches long and parallel to the longitudinal axis of pallet 25.

Figure 5:
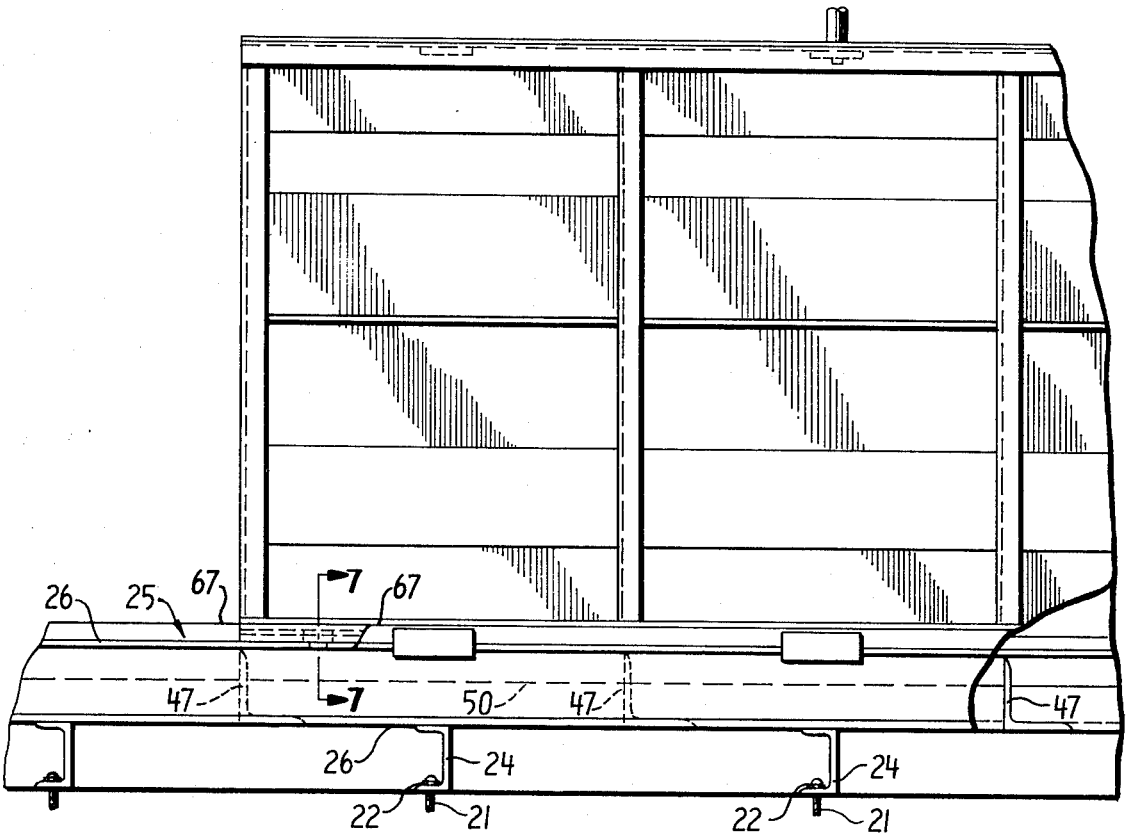
FIG. 5 is a broken side elevation of the pallet and a side form.

Each pallet section 26 comprises the side angle beams 44 and an upper plate 46 which is welded or otherwise secured as desired to the beams 44. Plate 46 is also secured by welding or other suitable means to a plurality of transverse L-type beams 47 (FIG. 5) which are also secured to beams 44 to form an underlying framework for each pallet section 46. For further support of plate 46, a plurality of longitudinal reinforcement straps 50 are welded or otherwise secured to the bottom of plate 46 and extend between the beams 47.

Permanent pallet 26 receives a pair of side forms designated generally by reference numeral 51. It should be appreciated that side forms 51 are readily placeable upon, or removable from, pallet 25 and that various side forms may be utilized for this purpose depending upon the specific type of concrete structure to be molded. The particular side forms 51 shown in the drawings are for molding a concrete I-beam of the desired section. Each form 51 comprises a horizontal foundation part 52, a generally vertical molding part 54 which extends upwardly from the inner portion of the foundation part 52 and an upper flange part 55 which is horizontal and receives a top brace 56 which is provided to bridge parts 51 and hold the upper portions of the mold in their desired positions when concrete is received between forms 51. Vertical frames 57 are provided, together with horizontal frames 60, to brace and give rigidity to forms 51. Also, at the juncture of the vertical mold part 54 and the horizontal mold part 52, a stiffener angle piece 62 is secured thereto by welding or other appropriate means further to insure the rigidity of the form 51. Further, a chamfer strip 64 is welded to the side form 51 at the junction of the foundation part 52 and vertical part 54 to provide the desired section in the concrete structure to be molded. Foundation part 52 and piece 62 are provided with openings 65 comprising slots preferably about four inches long which are placed directly over key hold type slots 66 in the plate 46 of pallet section 26.

Figure 1:
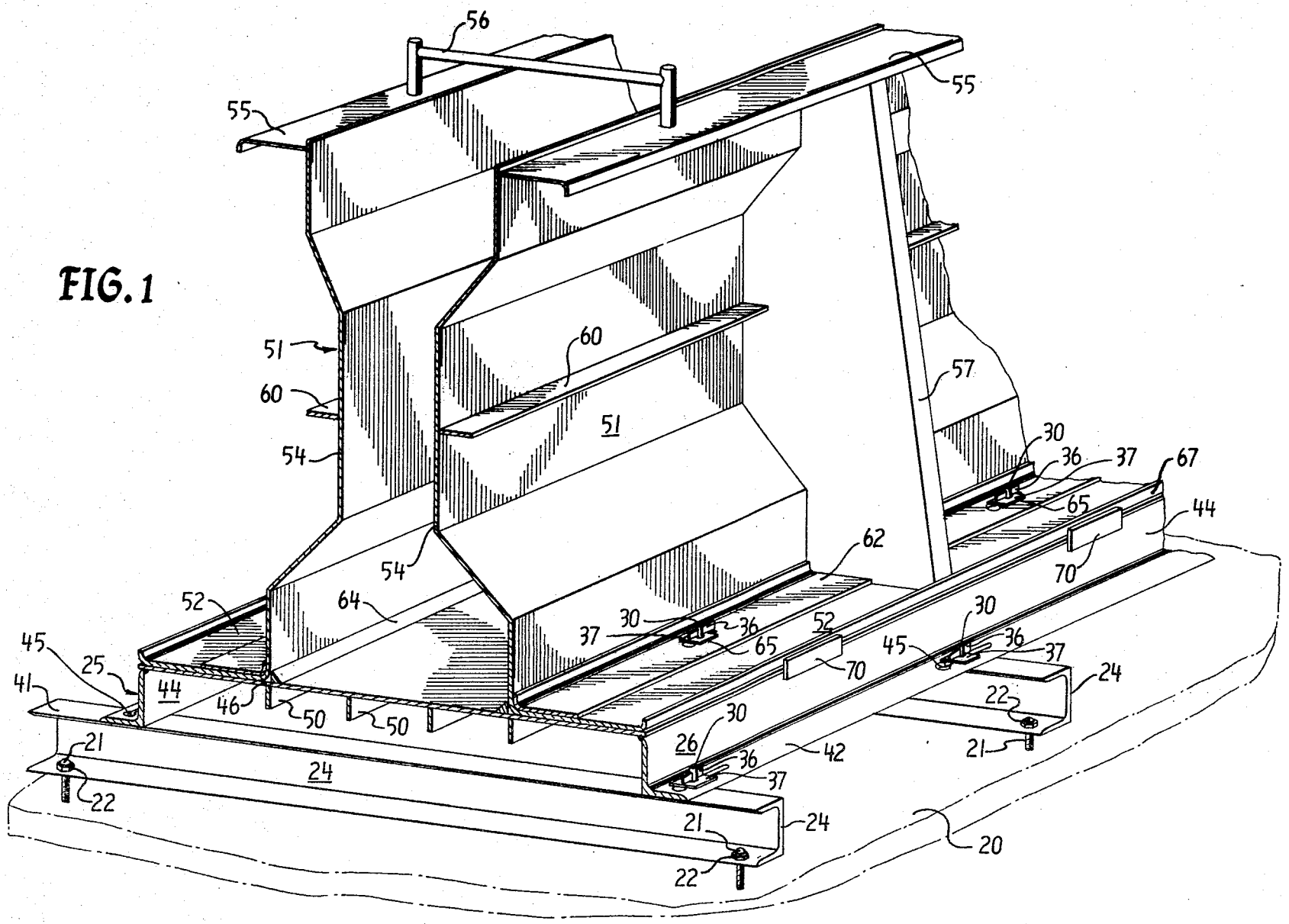
FIG. 1 is an isometric view, which shows, with portions broken away, the pallet and side girder forms fastened thereto.
Figure 2:
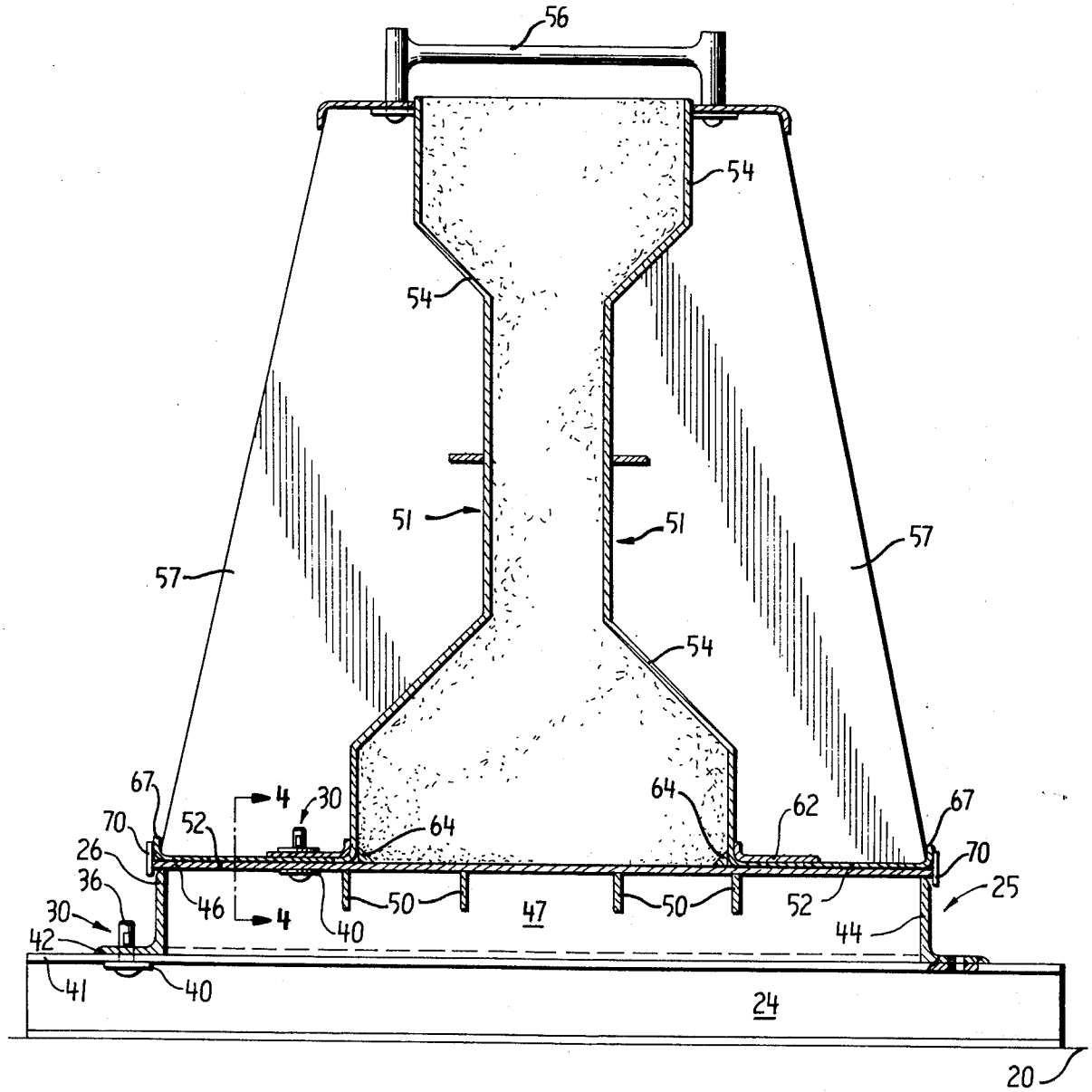
FIG. 2 is an end elevational view of the pallets and side forms.
Figure 3:
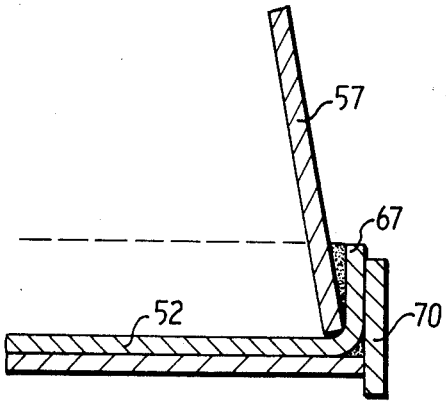
FIG. 3 is a detail view illustrating the stops for aligning the side forms and the pallet.
Figure 6:
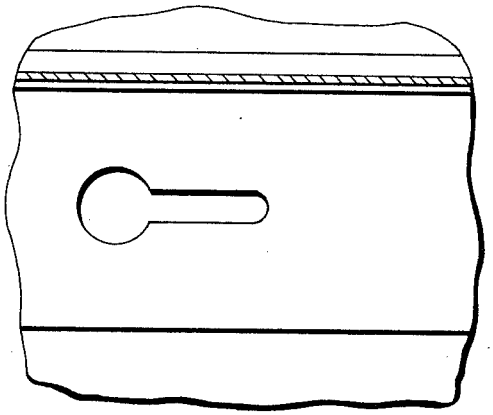
FIG. 6 is a broken plan view illustrating a key hole type slot formed in the foundation part of the side form.

As may be seen in detail in FIG. 3, foundation part 52 of each side mold 51 is provided with a vertical flange 67 which has welded to it stop means comprising aligning tabs 70 which are arranged to fit snugly against the edges of plate 46 of each pallet section 26 as may be seen in FIG. 2. This insures proper alignment. Key bolts 30 are then received through the openings 66 and 65, as previously described, and by means of wedges 36 the side forms 51 are clamped in place for receiving concrete in the casting operation.

Molding structures received over the ends of mold sides 51 and for positioning reinforcement within the mold are not shown inasmuch as they are conventional in the art and, as such, do not form a part of the invention.

When forms such as forms 51 are placed on the pallet 25, openings 65 and 66 are aligned and the aligning tabs 70 are brought snugly against the edges of the upper plates 46 of each pallet section 26. Key bolts 30 are then inserted through the bottom of the side forms 51 and plates 46 and wedges 36 are driven into slots 45 whereby they are firmly wedged therein. This locks side forms 51 in place for receiving concrete and with top braces 56 and end forms (not shown) in position, and reinforcement properly positioned, the pouring commences. After a structure so cast is sufficiently hardened (as seen in FIG. 2), the forms 51 are loosened or readily removed by simply tapping the smaller sides of wedges 36, removing the key bolts 30 and moving side forms 51 away from the cast concrete structure.

Having thus described our invention, what we claim as new and desire to secure by Letters Patent of the United States is:

1. A mold for the manufacture of concrete structural members such as girders, the mold comprising: a concrete base; a plurality of parallel beams affixed to said base and having their upper surfaces in the same plane; a pallet which comprises a plurality of pallet sections mounted on said beams, said sections being aligned and rigidly connected; a pair of removable side forms provided on said pallet, each said form comprising a horizontal foundation part which extends directly above said pallet to the edge of said pallet, a generally vertical molding part extending upwardly from the inner portion of said foundation part and which faces the molding part of the other said side form, an upper flange part which extends normally from the top of said molding part, and vertical plates connecting said parts; a plurality of openings in said foundation parts aligned with further openings in said pallet, said openings being disposed adjacent said molding part, readily removable clamp means extending through said aligned openings for rigidly clamping said forms to said pallet in a predetermined fixed relationship; and stop means provided affixed to the outer edges of said foundation parts for engaging the edges of said pallet and thereby aligning said forms relative to said pallet.

2. A mold in accordance with claim 1 wherein a stiffener angle piece is affixed in each said form along said foundation and form parts, said stiffener angle pieces having apertures aligned with the aforesaid aligned openings for receiving said clamp means.

3. A mold in accordance with claim 1 wherein rigid connection means are provided between the top portions of said forms for rigidly connecting same.

4. A mold in accordance with claim 3 wherein said rigid connection means are mounted across said upper flange parts of said forms.

5. A mold in accordance with claim 1 wherein a plurality of said forms are selectively provided for said pallet, each of said forms for molding girders of different cross-sections.

6. A mold in accordance with claim 1 wherein said clamp means comprises a bolt having its head adjacent its corresponding pallet and with a slot through its shank and a wedge receivable in said slot and adjacent its corresponding foundation part for rigidly clamping said foundation parts to said pallet.

7. A mold in accordance with claim 1 wherein said openings comprise slots which are parallel to the horizontal longitudinal axis of said forms, said further openings having a greater width in a portion thereof for receiving heads provided on said bolts.

8. A mold in accordance with claim 7 wherein washers are provided between said wedges and said foundation parts.

9. A mold in accordance with claim 8 wherein further washers are provided between said pallet sections and the heads of said bolts.

10. A mold in accordance with claim 1 wherein strap means is provided to bridge adjacent said pallet sections, holes in said strap means aligned with further holes in said pallets, a further plurality of clamp means received in said aligned holes clamping said strap means and adjacent pallet sections together.

11. A mold in accordance with claim 10 wherein said clamp means comprises a bolt with a slot through its shank and a wedge receivable in said slot for rigidly clamping said strap means to said pallet sections.

* * * * *